US012460906B2

(12) United States Patent
Chen et al.

(10) Patent No.: US 12,460,906 B2
(45) Date of Patent: Nov. 4, 2025

(54) SHAPED CHARGE LINERS WITH INTEGRATED TRACERS

(71) Applicant: Damorphe, Houston, TX (US)

(72) Inventors: Ting Chen, Sugar Land, TX (US); Indranil Roy, Sugar Land, TX (US); Kamel Bennaceur, Paris (FR); Hifzi Ardic, Houston, TX (US)

(73) Assignee: Damorphe, Inc., Houston, TX (US)

( * ) Notice: Subject to any disclaimer, the term of this patent is extended or adjusted under 35 U.S.C. 154(b) by 0 days.

(21) Appl. No.: 17/836,970

(22) Filed: Jun. 9, 2022

(65) Prior Publication Data

US 2022/0397376 A1 Dec. 15, 2022

Related U.S. Application Data

(60) Provisional application No. 63/208,610, filed on Jun. 9, 2021.

(51) Int. Cl.

| | |
|---|---|
| ***F42B 1/032*** | (2006.01) |
| ***E21B 47/11*** | (2012.01) |
| *E21B 43/117* | (2006.01) |

(52) U.S. Cl.

CPC ..... *F42B 1/032* (2013.01); *E21B 47/111* (2020.05); *E21B 43/117* (2013.01)

(58) Field of Classification Search

CPC ..... E21B 47/10; E21B 47/11; E21B 47/111; F42B 1/02; F42B 1/024; F42B 1/032; F42B 1/036

USPC ..... 102/305, 306, 307

See application file for complete search history.

(56) References Cited

U.S. PATENT DOCUMENTS

| | | | | |
|---|---|---|---|---|
| 3,188,955 | A * | 6/1965 | Brown | F42B 12/44 250/303 |
| 9,777,549 | B2 * | 10/2017 | Fripp | E21B 29/02 |
| 10,760,411 | B2 * | 9/2020 | Robey | E21B 47/11 |
| 11,292,960 | B2 * | 4/2022 | Planells | C09K 8/03 |
| 11,408,276 | B2 * | 8/2022 | Jabari | E21B 47/09 |
| 2012/0175109 | A1 * | 7/2012 | Richard | E21B 47/11 166/250.12 |
| 2015/0376992 | A1 * | 12/2015 | Grattan | E21B 43/117 175/4.57 |
| 2018/0135403 | A1 * | 5/2018 | Gupta | C09K 8/62 |
| 2020/0217629 | A1 * | 7/2020 | Loehken | E21B 43/117 |
| 2020/0408075 | A1 * | 12/2020 | Metzger | E21B 43/117 |
| 2021/0047903 | A1 * | 2/2021 | Albert | E21B 43/119 |
| 2021/0254938 | A1 * | 8/2021 | McNelis | F42B 1/028 |
| 2022/0017815 | A1 * | 1/2022 | Mohanty | E21B 43/267 |
| 2022/0074288 | A1 * | 3/2022 | Barker | F42B 1/028 |
| 2022/0381140 | A1 * | 12/2022 | LaGrange | E21B 47/11 |

* cited by examiner

*Primary Examiner* — John Cooper

(57) ABSTRACT

A liner for a shaped charge having integrated tracers. The liner, when the associated shaped charge is detonated, does not create a plug, carrot, or residue in the created perforation tunnel. The liner includes integrated tracers that, after detonation, are scattered into the perforation tunnel and then begin to flow back in formation fluid flow and are identifiable in the flow.

20 Claims, 6 Drawing Sheets

200
Shaped charge with tracers in liner
208
204
Pressure vessel

200
Detonation and depositing of tracers in perforation tunnel
210
204
208
211
Pressure vessel 200
213
210
211
205
Flowing back tracers under simulated reservoir pressure 200
206
Rock matrix
204
205
202

SHAPED CHARGE LINERS WITH INTEGRATED TRACERS

CROSS-REFERENCE TO RELATED PATENT APPLICATIONS

This application claims priority to U.S. Provisional Patent Application No. 63/208,610 entitled BIG HOLE CHARGE FOR PLUG AND ABANDONMENT filed Jun. 9, 2022 which is incorporated herein by reference in its entirety.

BACKGROUND

Shaped charges are commonly used in perforation and fracturing operations to create holes in a formation that facilitates hydrocarbon production. Many shaped charges are generally cone-shaped and have an interior concave region that faces outward toward the formation to focus the blast from the shaped charge outward. Shaped charges have evolved to include a liner on the concave region to protect the shaped charge during transport and run-in-hole.

SUMMARY

Embodiments of the present disclosure are directed to a shaped charge including a case having an interior volume, an explosive material in the interior volume of the case, and a liner in the interior volume. The explosive material is between the liner and the case. The liner is made from a powder complex comprising a powdered copper-lead mixture, a powdered additive complex comprising at least one of a bulk metallic glass composite (BMGC) or a high entropy alloy (HEA) material, and tracers for distinction and targeted identification. The tracers are absorbable in activated carbon or may be free flowing powder or a nano particulate. Upon detonation of the shaped charge a perforation tunnel is formed in a casing and into a formation in a well, wherein detonation deposits the tracers in the perforation tunnel, and wherein the tracers flow back with production fluid through the perforation tunnel.

DETAILED DESCRIPTION

Liners for shaped explosive charges in perforation tools may collapse and develop a high-speed jet creating tunnels in a subterranean formation during a perforation event. Such liners may be referred to as shaped charge liners. The present disclosure is directed to liners for shaped charges that, when the charge is detonated, does not leave a skin, carrot, or residue in the tunnel, thereby improving flowback characteristics of the formation. The liners of the present disclosure in some embodiments are made from a Bulk Metallic Glass Composite (BMGC) material and a High Entropy Alloy (HEA) material. During the detonation event, the materials react via a shock-induced entropy change to create a BMGC or HEA that preferably segregate to create high-angle domain boundaries or interfaces of the jetted liner material. As the jet progresses into the formation creating a perforation tunnel, segregated BMGC/HEA complex instantly reacts with formation fluids generating hydrogen, disintegrating the jet into a sputtered deposit.

Figure 1:
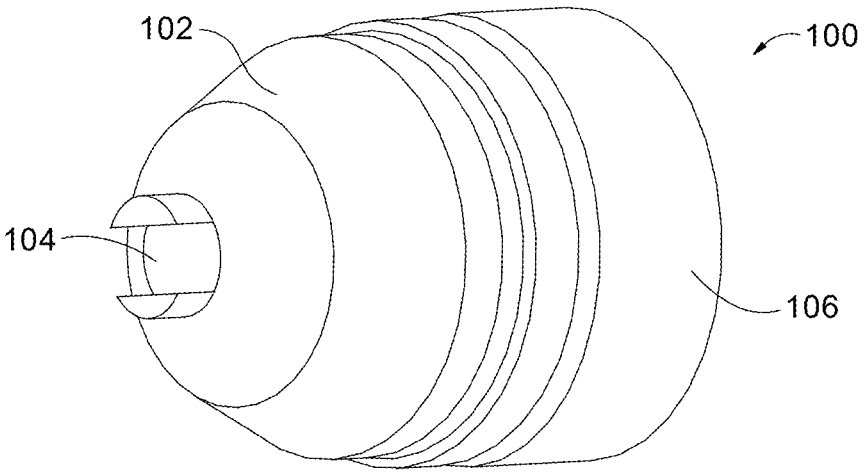
Figure 1 (prior art)
FIG. 1 depicts a shaped charge according to the prior art.

FIG. 1 depicts a shaped charge 100 according to the prior art. The shaped charge 100 includes a case 102, a detonator 104, and a cap 106. The shaped charge 100 can be part of a gun assembly including a Within the shaped charge is an explosive material that, when detonated by the detonator 104, causes a focused blast that perforates a casing, cement, and formation to enhance hydrocarbon extraction.

Figure 2:
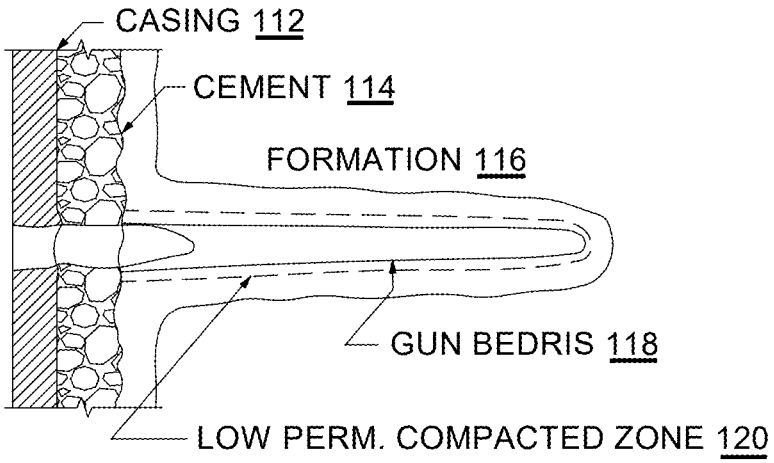
Figure 2 (prior art)
FIG. 2 is a schematic cross-sectional view of residue deposited by conventional shaped charges with conventional dissolvable liners according to the prior art.

FIG. 2 is a schematic cross-sectional view of residue deposited by conventional shaped charges with conventional dissolvable liners according to the prior art. The shaped charge has detonated and created somewhat of a perforation at 110. The perforation 110 penetrates a casing 112, cement 114, and into the formation 116. The effects of the shaped charge detonation reach further into the formation 116, but residual gun debris 118 is deposited at the end of the penetration, limiting the production from this perforation.

This forms a low permeation compacted zone 120 around the perforation. Conventional liners, even those intended to be dissolvable, leave this residue. During a conventional detonation event, a light metal that is added to conventional liners to promote anodic dissolution in fact instead violently burns off, destroying the metal jet stemming from the conventional liner. The retrenched jet with the secondary metal or metals from the conventional liner coats the perforation leaving the crushed zone lined with a non-dissolvable residue or skin. This prevents effective production from the hole. Additionally, because of the violent burn-off, the elasticity of the jet will not be maintained, which results in a big perforation hole with limited penetration. This flawed premise for conventionally designed shaped charges and liners explains the lack of successful commercial offerings for dissolvable shaped charge liners.

Figure 3:
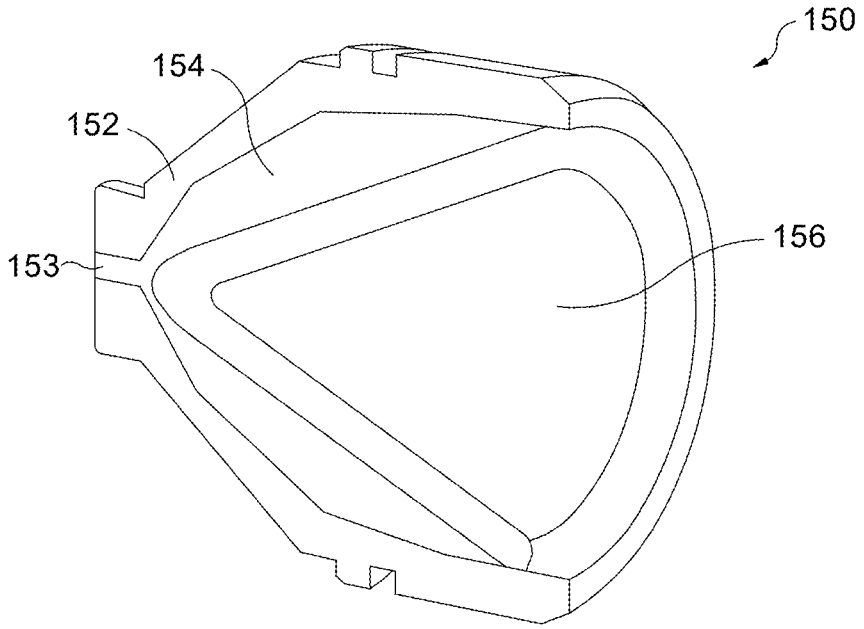
FIG. 3 is a schematic cross-sectional view of a shaped charge having a dissolvable liner according to embodiments of the present disclosure.

FIG. 3 is a schematic cross-sectional view of a shaped charge 150 having a dissolvable liner 156 according to embodiments of the present disclosure. The shaped charge 150 includes a case 152 and an explosive material 154 packed into the case 152. A port 153 can be configured to interact with a detonation device (not shown) that ignites the explosive material 154 at the desired time. A shaped charge liner 156 (a.k.a. liner) is included inside the case 152. The liner 156 has a conical shape with a convex side contacting the explosive material 154 and a convex side opposite that is vacant.

Figure 4:
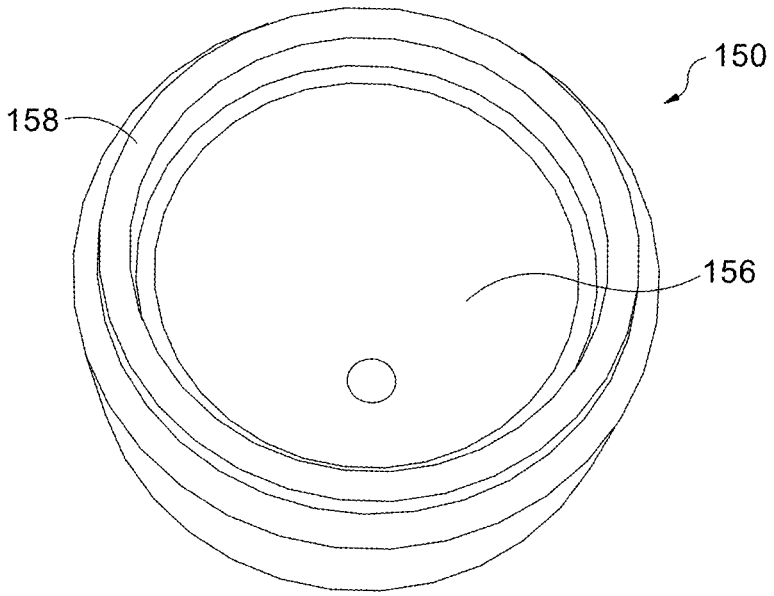
FIG. 4 shows the shaped charge from the discharge end with the liner installed according to embodiments of the present disclosure.

FIG. 4 shows the shaped charge 150 from the discharge end with the liner 156 installed according to embodiments of the present disclosure. The liner 156 seals into the case 152 to protect and isolate the explosive material. A distal rim 158 of the case 152 is shown protruding beyond the liner 156. The size and shape of the liner 156 can vary greatly and can be used with virtually any size or type of shaped charge.

Figure 5:
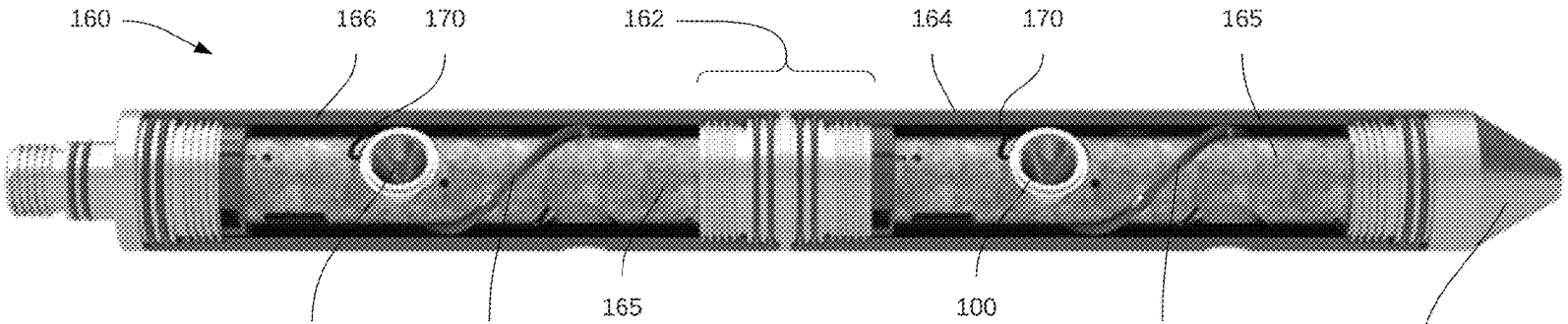
FIG. 5 is a schematic, partially cross-sectional view of a perforating gun including shaped charges and dissolvable shaped charge liners according to embodiments of the present disclosure.

FIG. 5 is a schematic, partially cross-sectional view of a perforating gun 160 including shaped charges 100 and dissolvable shaped charge liners according to embodiments of the present disclosure. The gun 160 can include any number of gun segments that are coupled together to form a gun 160 of a desired size. The depicted embodiment has two such gun segments, a first gun segment 164 and a second gun segment 166. A nosepiece 162 is fastened to a distal end of the first gun segment 164 which will be further downhole than the second gun segment 166. A coupling member 162 joins the gun segments together. Within each gun segment is a mandrel 165 that is a generally cylindrical member having radially-oriented holes positioned at circumferentially and axially varied positions. The holes carry shaped charges 100. The gun segments also include a detonating cable 168 which terminates as a lead 170 to the shaped charges 100 in the radially-oriented holes. The cables 168 and leads 170 provide the energy to detonate the shaped charges 100 when the time is right.

In some embodiments the liner 156 is made of a combination of copper, lead, and tungsten. The materials of the liner 156, in this case copper, lead, and tungsten, are combined in powder form. In some embodiments the material is made of solid copper or an alloyed copper liner. In some embodiments the liner also includes an additional solid metal liner stemming from an electrochemically active alloy such as Zinc or a Zinc alloy which is processed onto the copper alloy liner by mechanical means. The use of a powder compact negates formation of plug or carrot at the end of a perforation tunnel or a skin on interior surfaces of the perforation tunnel. Use of the powder compact maintains the conductivity of the material left behind in the perforation tunnel which enables the residue to dissolve and therefore not obstruct production from the perforation tunnel.

In some embodiments the powder complex is made of a copper or copper alloy. The powder complex can include a copper-lead mixture. The powder complex can also include be a superplastic alloy such as a Zn-22 wt. % Al eutectoid material. In some embodiments a multi-phase High Entropy Alloy (HEA) with glass forming abilities area added to the blend to promote formation of amorphous intergranular fringes (AIF, a.k.a. complexions), engineered to react at tailored degradation rates with aqueous or organic phases. These materials can disintegrate on a timed exposure to the environment. In other embodiments super-hard materials such as sintered carbides or nitrides can be used. Examples of super-hard materials are SiC, $Si_3N_4$, $B_4C$, BN, $AL_2O_3$, Zr and Zr—$Al_2O_3$, $Al_2O_3$—Zr, and $B_4C$—SiC. These materials have ultra-refined and classified particle size distribution. On such example is F1000 or F1500 that can be added to the blend. These materials are selectively deposited on the perforation tunnel to prevent collapse of fine conductive channels while creating a porous permeable layer, rather than an impermeable skin that is formed using conventional shaped charge liners. This allows improved hydrocarbon flowback and increased conductivity of the perforation pathway. In some embodiments the powder material consists of refractory and other metal powders such as W, Mo, or Zr to add weight and elasticity to the formed jet, thus promoting a deeper penetration.

In some embodiments the multi-phase powders with a glass forming ability are added to the blend to promote formation of amorphous intergranular films (AIF) and/or complexions that are engineered to react at tailored degradation rates with aqueous or organic phases that disintegrated on a timed exposure. This increases system enthalpy, flares the jet, which results in a larger hole even when shot from a smaller diameter gun such as a 3⅛ inch OD gun.

Further examples of refractory alloy powders may be a combination of ITAR (International Traffic in Arms Regulations) registered alloys such as Titanium Zirconium, Molybdenum (TZM), Lanthanated Molybdenum (MoLa), Tungsten heavy alloy (W), or other metals and alloyed forms of the elements Niobium, Tantalum, Rhenium, Hafnium, Zirconium, and Iridium.

In some embodiments the powders are processed via severe plastic deformation (SPD) to produce nano-crystalline and ultrafine grains. The ultrafine grains in the SPD processed powders manifest into "high strain rate super plasticity" of the formed jet at temperatures during detonation.

In some embodiments a gradient material liner can be produced consisting of dissimilar metals or alloys that can be produced by repeated strikes in a liner press. A polymer or a wax can be selectively introduced between gradients to increase gradient material reactivity which results in a big hole even when shot from a relatively small diameter gun such as a 3⅛ inch OD gun.

Figure 6:
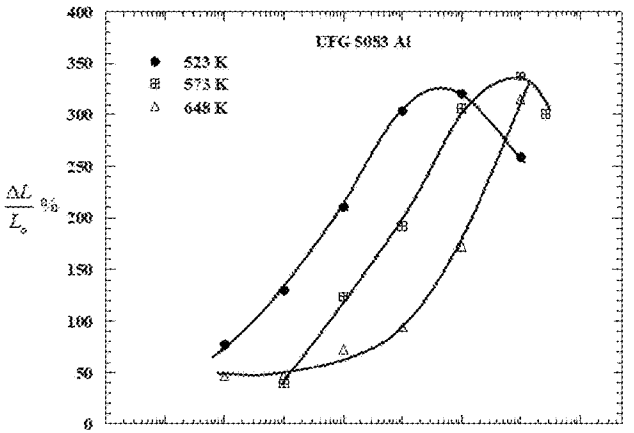
FIG. 6 is a plot of average percentage of elongation at fracture as a function of the initial strain rate for materials used in the shaped charge liners of the present disclosure.

FIG. 6 is a plot of average percentage of elongation at fracture as a function of the initial strain rate for materials used in the shaped charge liners of the present disclosure. The initial strain rate, A), is shown at three different temperatures: 523, 573 and 648 K for ultrafine grained Aluminum alloy processed via severe plastic deformation (SPD). Considered together, the three ductility curves plotted in FIG. 6 reveal the following features: (i) as the testing temperature is increased, the position of ductility peak shifts to higher strain rates, (ii) the maximum attainable ductility increases with increasing temperature, and (iii) under the present experimental conditions, UFG 5083 Al exhibits maximum elongations of more than 300% (superplasticity).

Figure 7:
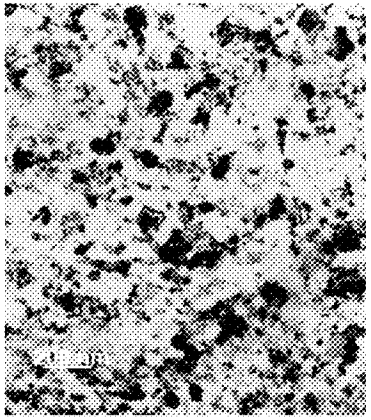
FIG. 7 shows ultrafine grained microstructure of SPD processed aluminum alloy 5083.
Figure 8:
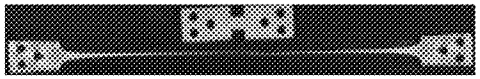
FIG. 8 depicts superplastic deformation of Zn-22% Al.
Figure 9:
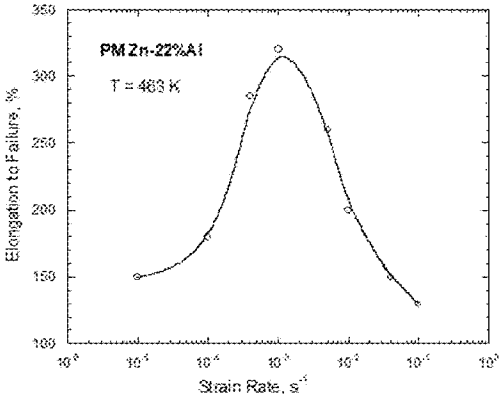
FIG. 9 is a plot of elongations to failure at different initial strain rates of PM Zn-22% Al at a temperature of 463K.
Figure 10:
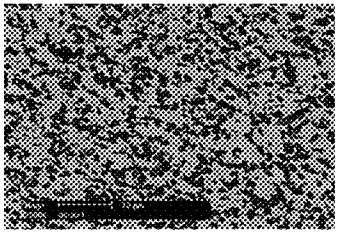
FIG. 10 is a scanning electron micrograph of an extruded Zn-22% Al alloy depicting ultrafine grained microstructure.

FIG. 7 shows ultrafine grained microstructure of SPD processed aluminum alloy 5083. FIG. 8 depicts superplastic deformation of PM Zn-22% Al. FIG. 9 is a plot of elongations to failure at different initial strain rates of PM Zn-22% Al at a temperature of 463K. FIG. 10 is a scanning electron micrograph of an extruded Zn-22% Al alloy depicting ultrafine grained microstructure. The underlying grain refined microstructure exhibits a high strain rate super plasticity.

Applications of tracers in oil and gas for sensing and characterization are decades old and of late, being more commonplace. With technology maturity, tracer applications and tests are yielding better results. Current drawbacks with tracer technology and its applications in oil & gas are some uncertainties relating deployment and recovery and a complex, time consuming analyses. With the advent of chemical tracers, its use for enhanced oil recovery (EOR) took off in the mid 1990s'. With effective placement, tracers are able to yield information regarding fluid flow through a reservoir, breakthrough times from injector to producers, and also provide useful estimations of the inter-well oil saturation. Understanding how tracer particles flow through a reservoir and what factors affect it allow an operator to gain proper qualitative and quantitative information to characterize.

Tracers can be classified into 4 categories:

1. Conservative;
2. Radioactive;
3. Partitioning; and
4. Nanoparticle tracers.

"Conservative Tracers" are chemical indicators used for evaluating the media it is being deployed in or placed. "Radioactive Tracers" are similar to conservative tracers, but are also radioactive. Radioactivity allows flexibility in detection and measurement in alternate ways that other tracers cannot offer. "Partitioning Tracers" interact with the oil or the aqueous phase and it allows, with the use of a conservative tracer, the calculation of potential oil in place and remaining oil saturation or flowback analysis including water break through.

Recently there has been a lot of advancement in the area of "Nanoparticle Tracer" encompassing "quantum dots embedded on nanoparticles" and is being evaluated for use with remote sensing. These have the potential to disrupt the industry, being more environmentally friendly and economical. Nanoparticles can also be applied to assess how multiple tracers moves through a reservoir and its applications is useful for laminated rock an also in low permeability zones for example shales as well as sorted sandstone formations.

Chemical tracers have specific uses and applications. These reasons are generally natural occurrences of certain chemical in the reservoir that would avoid getting a misreading during the analysis of recovered fluids. Some research has provided details of tracer selection and tracer criteria. We now have a wide range of available tracers and their use in oil, water or gas is dependent on the size and character of the reservoir in which they are placed. Tracer test is useful in characterizing the subsurface and finding residual oil in place using partitioning tracers, a broader outreach and market will depend on either economics or environmental regulations.

Tracers in powder form is be added to a dissolvable blend as a matrix mix and is subsequently processed by cold or hot pressing followed by sintering as a standalone process or subsequent cold or warm working to shape. Another route includes powder injection molding followed by low temperature sintering when a carefully selected binder with outgassing temperature below sintering temperature ensures success of the consolidation process and the survivability of the tracer material in the dissolvable bulk. If the tracer is a liquid, it needs to be accommodated (adsorbed or absorbed) in a dissolvable alloy matrix of controlled porosity and permeability which may be coated with a barrier or a membrane having controlled release through Fickian diffusion. The volume of tracer adsorbed or absorbed is an order of magnitude or more (20-25%) more than that laced on activated carbon (2-3%).

The tracer impregnated dissolvable solid compact can be of any shape or form which is useful for an application such as with liners for shaped charges as disclosed herein.

In some embodiments, tracers are synthetic nano-particles that are mixed in the liner which survives subsequent detonation and is deposited in the perforation tunnel and flows back with production fluids. Tracers can be radioactive chemicals with specific miscibility in organic and inorganic fluids. Tracers can also be rare-earth oxides or other synthetic nanocrystals which are adsorbed in activated carbon, and/or nanoparticles for distinction and targeted identification. The tracers can be detected at the surface as the tracers flow back through an in-flow device containing an optical means such as a collimated laser or by other non-optical means. Identifying the tracers can relate valuable downhole information remotely to the surface. The tracers can be remotely monitored using a flow through device installed up-stream or down-stream of a device based on flow for targeted identification using sampling followed by an inductively coupled plasma (ICP) mas spectrometry device, a Geiger-Müller counter or detection method depending on the corresponding tracer.

In some embodiments can be present in solution as colloidal particulates, including surface adhering, matrix mixing, impregnating, adsorbing, or absorbing in a permeable and porous dissolvable scaffold. In energy, or elsewhere the "flowback" brings these particulates back to the surface.

The tracers can be a rare-earth doped oxide, sulfide, and halide nanocrystals that emit unique infrared and visible fingerprints when illuminated by very specific laser sources. The tracers can be nano-crystals that manifest unique emission and absorption spectra and engineered decay times based on their optical, physical magnetic, radioactive, luminescent properties. The tracers can be programmed and designed to have a tailored crystallite size, wherein their identification in parts per billion can be made according to custom spectroscopic and optical detector systems.

The tracers can have unique signatures. The tracers can also be sandwiched between gradients of the material blend of the liner and as such deposit on the inside of a discharged gun and produced perforation holes serving as an identifier of a type of charge, its manufacturer, the service provider, or the operator or any other entity to which the signature pertains. In some embodiments the signature is proprietary to the entity and is not generally known. The signature can be identifiable according to a provider of the tracer, which can be a manufacturer of the tracer, a vendor of the tracer, or an operator who obtains the tracer from a manufacturer. The signature can allow identification of tracers in wells that may have equipment including tracers with different signatures provided by other entities, providers, vendors, operators, or manufacturers.

In some embodiments the identified particulate and related result is remotely relayed to any global computing device such as a laptop, smartphone, PDA, or the like for immediate apposite and measurable action.

In some embodiments the gradient materials have weaved-in tracers and can be produced via cold isostatic pressing (CIP) or spark plasma sinter (SPS) methods. The gradient material blended liner can be cold, warm, or hot forged to shape in a closed die. In some embodiments the forged liner can be re-stricken to reduce porosity and heal material, and thus abet super-plasticity and the elasticity of the produced jet.

In some embodiments the shaped charge liners can be made from a powder compact which is pressed into shape using a hydraulic press or other similar pressure-applying mechanism. The high pressure causes the powders to solidify into the desired shape. A coating such as a GLYPTAL™ can be applied to the liner 156, which can then be pressed onto the shaped charge against the explosive material 154 and into the case 152. The shaped charge 150 and liner 156 are now ready for deployment.

The metal powders have a tailored particle size distribution that maximizes the tap density of the blend. When the shaped charge 150 is detonated, behind the liner a liner-metal jet is formed which punctures the gun, the casing, and finally penetrates the formation, thus creating a perforation tunnel. During the detonation, the metal powders react via a shock induced entropy-change (or propagating pressure wave) to create a bulk metallic glass (BMG). In other embodiments, a high entropy alloy (HEA) is used and it preferentially segregates to the high angle boundaries or interfaces of the liner material deposited on the crushed zone, coating the perforation tunnel. In some embodiments the BMG materials are used with the HEA materials. In other embodiments the BMG materials are used without the HEA materials, and in other embodiments the HEA materials are used without the BMG materials.

In any of these embodiments, BMG, HEA, or BMG+HEA, the materials segregated at the high angle boundaries or the domain interfaces of the liner-metal skin on the perforating tunnel reacts with formation fluids and is selectively etched. This results in the metal coating and slug at the end of the perforation tunnel disintegrating into minute particulates that are easily removed via flowback. The result is a clear pathway for hydrocarbons to flow from the formation.

In some embodiments the powder compact can be manufactured using additive manufacturing. The shaped charge liners can also be made from a powder compact using cold isostatic pressing (CIP) of the powder compact or a spark plasma sinter (SPS) method. In other embodiments the shaped charge liners can also be made using a hot forge in a closed die. In other embodiments the charge liner is designed from a powder compact using additive manufacturing. In other embodiments the gradient materials have weaved-in tracers and can be produced via cold isostatic pressing or spart plasma sintering. In other embodiments the liner can be forged and can be re-stricken to reduce porosity and heal material, to thus abet super-plasticity and elasticity of the jet produced by detonation of the shaped charge.

Figure 11A:
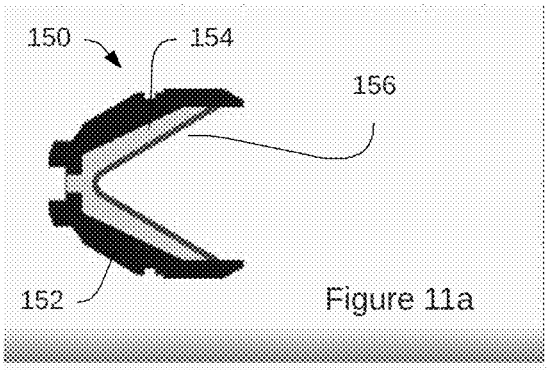
FIGS. 11*a*-11*h* show a progression of a detonation event in a shaped charge having a dissolvable liner according to embodiments of the present disclosure.
Figure 11B:
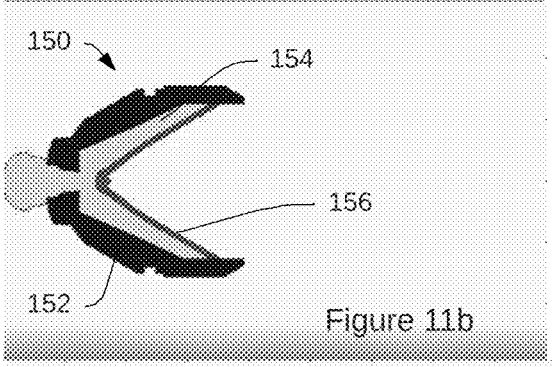
Figure 11C:
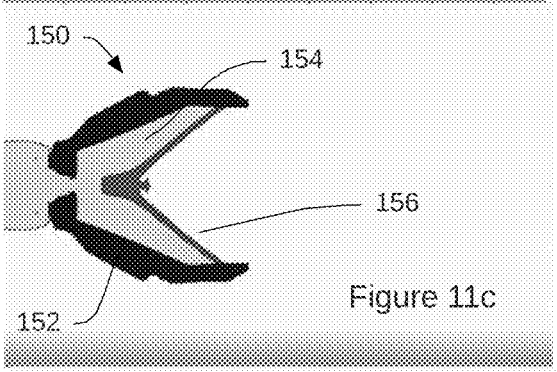
Figure 11D:
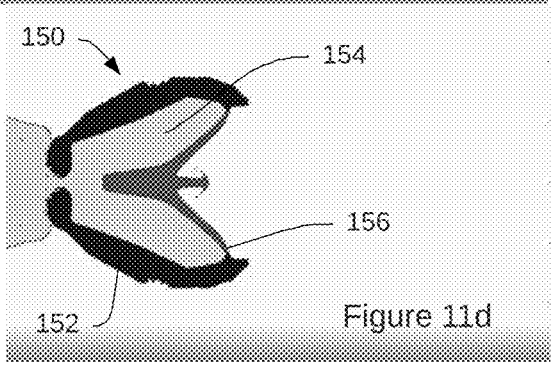
Figure 11E:
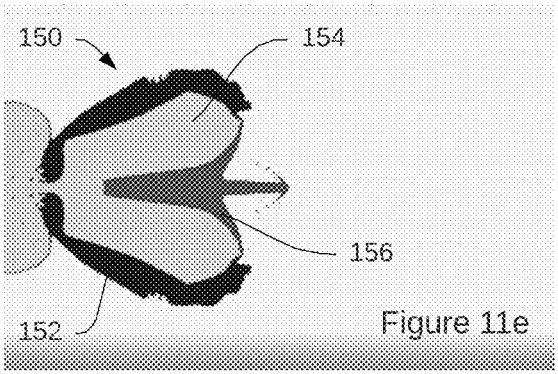
Figure 11F:
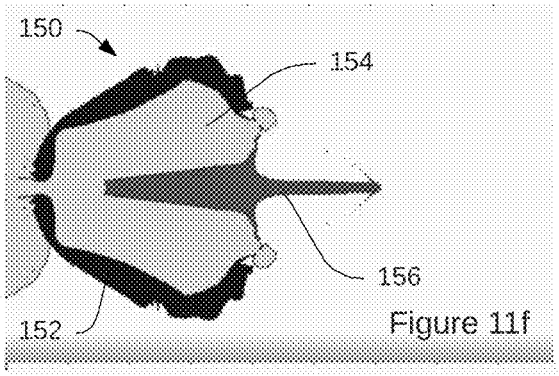
Figure 11G:
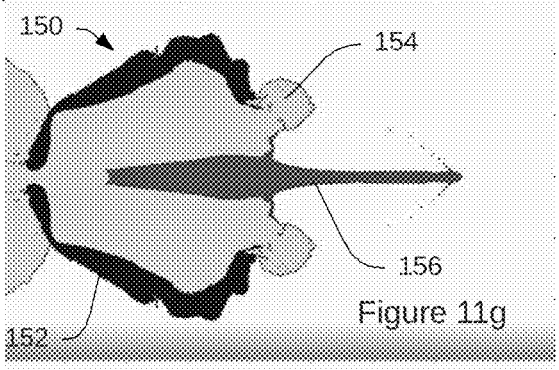
Figure 11H:
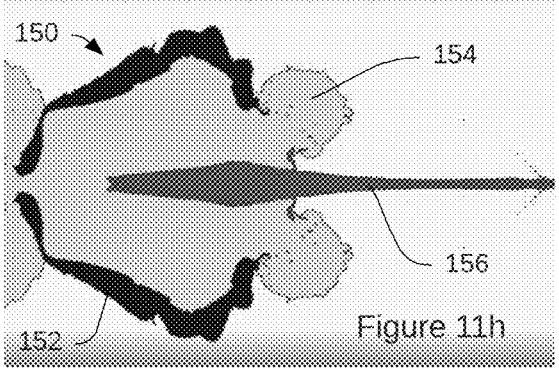

FIGS. 11*a*-11*h* show a progression of a detonation event in a shaped charge having a dissolvable liner according to embodiments of the present disclosure. This process is of course a continuous process that happens in an extremely short time frame. These images are to show the progression in a series of arbitrarily chosen moments. The components of the shaped charge 150 are a case 152, an explosive material 154 (a.k.a. explosive), and a liner 156. FIG. 11*a* shows the shaped charge before detonation. The liner is in its conical shape as shown in FIGS. 3 and 4. The explosive 154 fills the space between the case 152 and the liner 156. FIG. 11*b* shows the initial movement after detonation. The explosive 154 firsts exits the rear (toward the detonator) due to lower resistance in that direction. The liner 156 begins to deform. FIG. 11*b* shows further progression. The liner 156 is beginning to coalesce into a focused jet in the center of the shaped charge 150. The casing 152 is beginning to flex and expand under intense heat and pressure in the exploding explosive 154. FIG. 11*d* shows still further progression. The liner 156 is still connected to the case 152 at the distal end (the large end of the conical shape). The liner 156 is continuing to focus into the center to form the desired metal jet. FIG. 11*e* shows the connection between the case 152 and liner material just about to give way. The jet from the liner 156 at the center is beginning to accelerate out of the shaped charge 150. FIG. 11*f* shows the case 152 deforming substantially and the explosive material 154 breaking the seal between the liner 156 and the case. The jet of liner material 156 has developed and is still accelerating through casing, cement, and/or formation (not pictured). FIG. 11*g* shows these developments increasing yet further. FIG. 11*h* shows the material of the liner 156 now in a nearly linear focused beam of molten metal that impacts the formation with devastating force.

The result of the detonation event shown here results in a perforation tunnel that extends deep into the formation. Due to the material makeup of the liner 156, the liner material 156 is either dissolved during the detonation event, or it remains in the perforation tunnel but is rendered highly reactive to formation fluids and will break up into very small particles in minutes. These particles are easily flowed back due to the natural pressure coming from the formation and will not impede hydrocarbon production. Compare to the conventional design and materials which leave a substantial plug that does not dissolve and renders the perforation much less able to produce hydrocarbons.

In some embodiments the liners for the shaped charges disclosed herein can include a gradient material that is formed by blending two or more powdered materials having dissimilar specific gravities. An organic material, such as a polymer or a wax, can be blended with the powdered materials. The combination of these materials can be subject to a force such as a centrifugal force that causes the materials to align according to specific gravity. At this point a further processing step can be performed to solidify or otherwise work the materials. Such further processing steps include cold isostatic pressing or severe plastic deformation or other such processes. In the embodiments of the present disclosure, a cone-shaped liner can be so produced using the symmetry of the cone shape for the liner to construct the gradient material.

Figure 12:
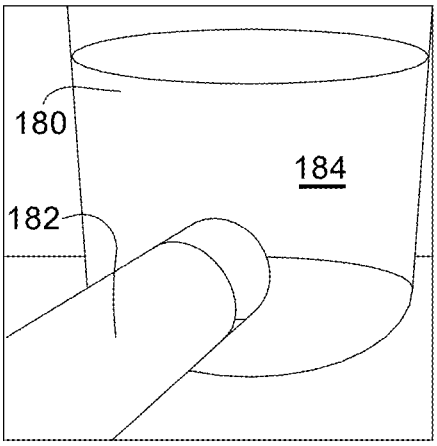
FIG. 12 is a representation of a container of fluid not containing tracers according to the present disclosure.
Figure 13:
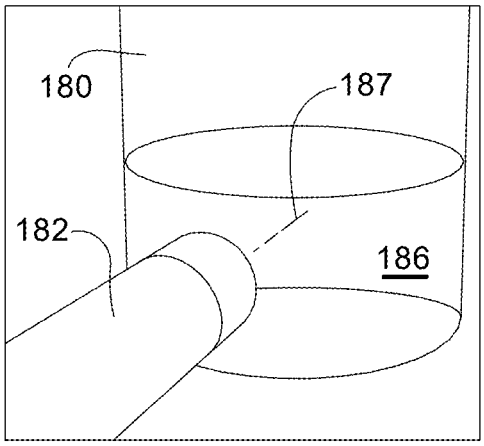
FIG. 13 is a representation of a container of a fluid that contains tracers according to the present disclosure.

FIG. 12 is a representation of a container 180 of fluid 184 not containing tracers according to the present disclosure. A collimated laser source 182 is directed into the fluid 184 and does not reveal the presence of tracers in the fluid 184. FIG. 13 is a representation of a container 180 of a fluid 186 that contains tracers according to the present disclosure. A collimated laser source 182 is directed into the fluid 186 and the tracers in the fluid 186 are scintillated and a light is emitted in the visible spectrum. The tracers can be configured to reflect light of virtually any spectrum visible to the human eye or otherwise detectable via optical equipment. The collimated laser source 182 has a known wavelength. The fluid in each container 180 is an aqueous brine.

Figure 14:
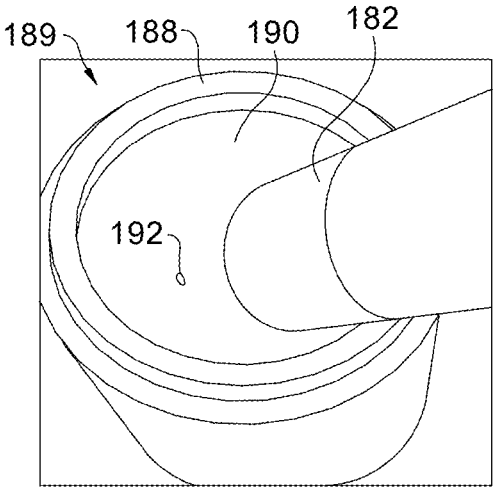
FIG. 14 depicts a shaped charge containing tracers according to embodiments of the present disclosure.

FIG. 14 depicts a shaped charge 189 containing tracers according to embodiments of the present disclosure. The shaped charge 189 includes a case 188 and a liner 190. An explosive is beneath the liner 190 and is not visible. A collimated laser source 182 is directed onto the liner 190 and a green light 192 is visible reflecting the laser source. This is visible in a live shaped charge.

Figure 15:
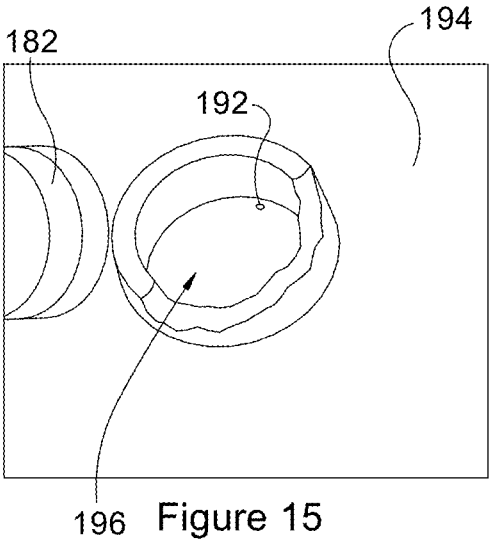
FIG. 15 depicts a portion of a casing after being penetrated by a shaped charge having a liner impregnated with tracers according to embodiments of the present disclosure.

FIG. 15 depicts a portion of a casing 194 after being penetrated by a shaped charge having a liner impregnated with tracers according to embodiments of the present disclosure. The detonation of the shaped charge makes a hole 196 in the casing 194 and causes the tracers in the liner to scatter and contact the casing 194. A collimated laser source 182 is directed to the exposed surface of the casing 194 and a green light 192 is visible reflecting the collimated laser source.

Figure 16:
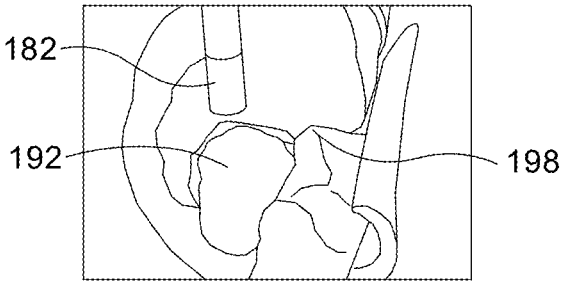
FIG. 16 depicts a portion of rock in a simulated detonation into a formation using a shaped charge having a liner impregnated by tracers according to embodiments of the present disclosure.

FIG. 16 depicts a portion of rock in a simulated detonation into a formation using a shaped charge having a liner impregnated by tracers according to embodiments of the present disclosure. The rock 198 is fractured by the detonation of the shaped charge, and the tracers in the liner are scattered and contact the rock 198. A collimated laser source 182 is directed to the exposed surface and a green light 192 is visible. Accordingly, the tracers are detectable on the surface of the rock 198.

Figures 17, 18, 19, 20:
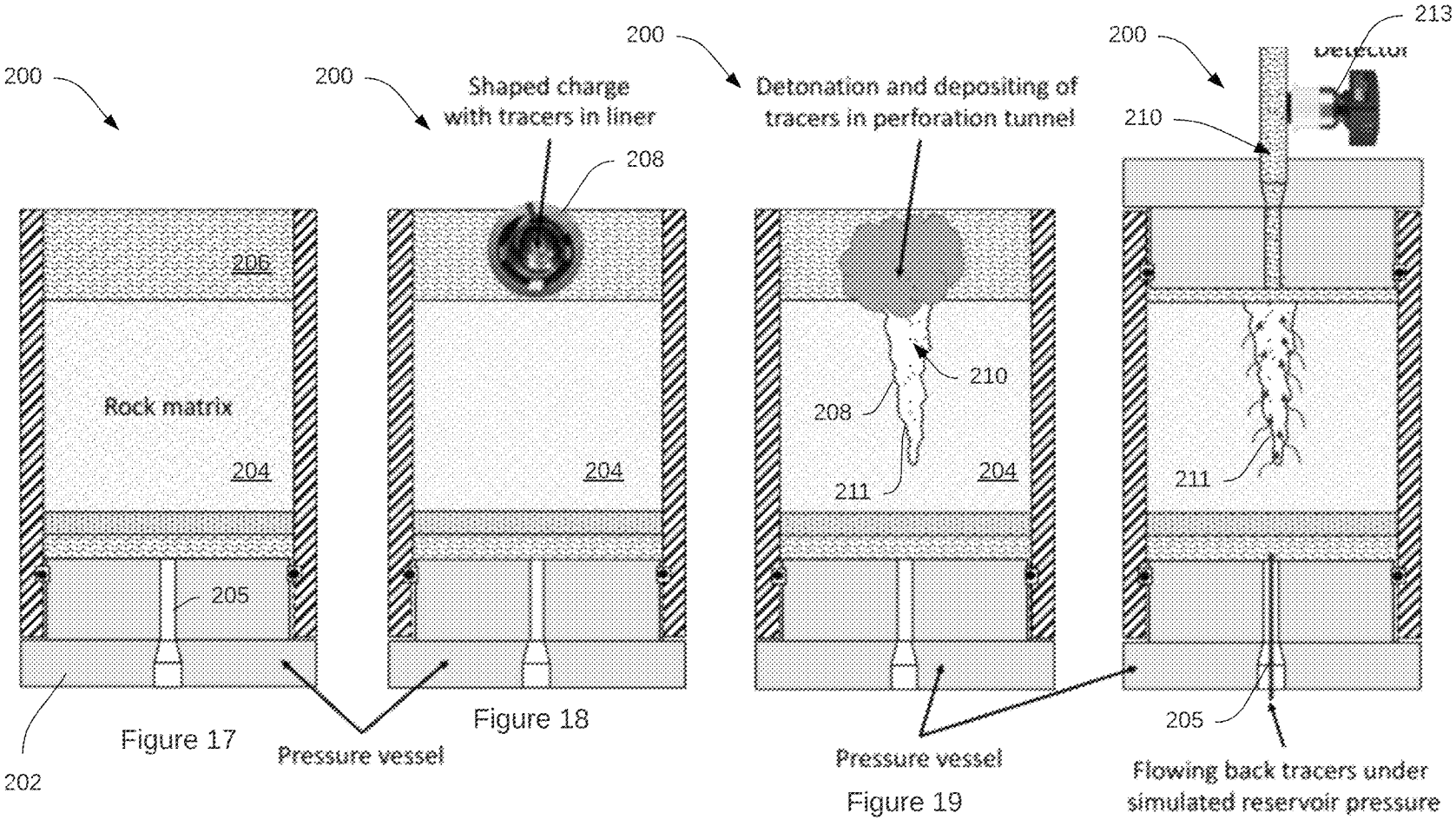
FIG. 17 shows a cross-sectional view of a pressure vessel used to simulate downhole conditions in which tracers in a shaped charge liner are deposited into a perforation tunnel and flowed back to the surface and detected according to embodiments of the present disclosure.
FIG. 18 shows the pressure vessel with a shaped charge with tracers in a liner according to embodiments of the present disclosure.
FIG. 19 shows the pressure vessel and rock matrix after detonating the shaped charge shown in FIG. 18 according to embodiments of the present disclosure.
FIG. 20 shows the pressure vessel of FIGS. 17-19 after detonating the shaped charge and during flowback according to embodiments of the present disclosure.

FIG. 17 shows a cross-sectional view of a pressure vessel 200 used to simulate downhole conditions in which tracers in a shaped charge liner are deposited into a perforation tunnel and flowed back to the surface and detected according to embodiments of the present disclosure. A pressure vessel 200 contains a rock matrix 204 that simulates a formation in a well. The pressure vessel 200 has a port 205 that can be used to flow back fluid from the formation. The pressure vessel 200 is filled with a fluid 206 such as an aqueous fluid or other suitable reservoir fluid. The fluid 206 may include other constituents such as proppants, stimulation fluids, or other additives. The fluid 206 may be oil.

FIG. 18 shows the pressure vessel 200 with a shaped charge 208 with tracers in a liner according to embodiments of the present disclosure. FIG. 19 shows the pressure vessel 200 and rock matrix 204 after detonating the shaped charge shown in FIG. 18 according to embodiments of the present disclosure. The tracers 210 are released by the detonation and are scattered into the perforation tunnel 211.

FIG. 20 shows the pressure vessel 200 of FIGS. 17-19 after detonating the shaped charge and during flowback according to embodiments of the present disclosure. The port 205 is used to flow back hydrocarbons and other fluids from the formation. Tracers 210 are carried by the formation fluids out of the perforation tunnel 211 up to the surface where a detector 213 is placed to monitor for the presence of the tracers. The presence, velocity, quantity, and even type of tracer can be monitored by the detector 213.

The foregoing disclosure hereby enables a person of ordinary skill in the art to make and use the disclosed systems without undue experimentation. Certain examples are given to for purposes of explanation and are not given in a limiting manner.

The invention claimed is:

1. A shaped charge, comprising:

a case having an interior volume;

an explosive material in the interior volume of the case; and a liner in the interior volume, wherein the explosive material is between the liner and the case, wherein the liner is made from a powder complex comprising:

a powdered copper-lead mixture;

a powdered additive complex comprising at least one of a bulk metallic glass composite (BMGC) or a high entropy alloy (HEA) material; and tracers for distinction and targeted identification wherein the tracers are absorbable in activated carbon or may be free flowing powder or a nano particulate;

wherein, upon detonation of the shaped charge a perforation tunnel is formed in a casing and into a formation in a well, wherein detonation deposits the tracers in the perforation tunnel, and wherein the tracers flow back with production fluid through the perforation tunnel.

2. The shaped charge of claim 1 wherein the tracers are radioactive chemicals with specific miscibility in organic and inorganic fluids.

3. The shaped charge of claim 1 wherein the tracers are synthetic nano-particles, radioactive, chemicals with specific miscibility in organic and inorganic fluids, rare-earth oxides,) synthetic nanocrystals, or quantum dots.

4. The shaped charge of claim 1 wherein the tracers are identifiable within production fluid at a surface of the well after flowing back in the production fluid.

5. The shaped charge of claim 4 wherein the tracer is identifiable using an in-flow device containing a collimated laser.

6. The shaped charge of claim 4 wherein the tracers are monitorable using a flow through device using sampling and inductively coupled plasma (ICP) mass spectrometry device.

7. The shaped charge of claim 4 wherein the tracers are identifiable using a Geiger-Müller detector.

8. The shaped charge of claim 1 wherein the tracers are present in fluid as colloidal particulates, and wherein the tracers have one or more of the following fluid characteristics: surface adhering, matrix mixing, impregnating, adsorbing, or absorbing in a permeable and porous scaffold.

9. The shaped charge of claim 1 wherein the tracers are one or more of a rare-earth doped oxide, sulfide and halide nanocrystals that emit light of a predetermined frequency when illuminated by a laser.

10. The shaped charge of claim 1 wherein the tracers manifest identifiable emission and absorption spectra and decay times based on at least one of their optical, physical, magnetic, radioactive, and luminescent properties.

11. The shaped charge of claim 1 wherein the tracers have a precise crystallite size identifiable by a corresponding spectroscopic or optical detector.

12. The shaped charge of claim 1, further comprising a computing system configured to store and relay information remotely relating to identifying the tracers with the production fluid.

13. The shaped charge of claim 1 wherein the tracers are configurable to be identifiable according to a provider of the tracers.

14. The shaped charge of claim 1 wherein the tracers are integrated to the liner using additive manufacturing.

15. A shaped charge, comprising:

a case having an interior volume;

an explosive material in the interior volume of the case; and a liner in the interior volume, wherein the explosive material is between the liner and the case, wherein the liner is made from a powder complex comprising:

a powdered copper-lead mixture; and a powdered additive complex comprising a bulk metallic glass composite (BMGC) material;

wherein, upon detonation of the shaped charge a perforation tunnel is formed in a casing and into a formation in a well.

16. The shaped charge of claim 15, further comprising tracers for distinction and targeted identification, wherein detonation deposits the tracers in the perforation tunnel, and wherein the tracers flow back with production fluid through the perforation tunnel.

17. The shaped charge of claim 16 wherein the tracers are absorbable in activated carbon or may be free flowing powder or a nano particulate.

18. A shaped charge, comprising:

a case having an interior volume;

an explosive material in the interior volume of the case; and a liner in the interior volume, wherein the explosive material is between the liner and the case, wherein the liner is made from a powder complex comprising:

a powdered copper-lead mixture; and a powdered additive complex comprising a high entropy alloy (HEA) material;

wherein, upon detonation of the shaped charge a perforation tunnel is formed in a casing and into a formation in a well.

19. The shaped charge of claim 18, further comprising tracers for targeted identification wherein the tracers are absorbable in activated carbon or are free flowing powder or a nano particulate.

20. The shaped charge of claim 18 further comprising tracers for targeted identification wherein detonation deposits the tracers in the perforation tunnel, and wherein the tracers flow back with production fluid through the perforation tunnel.

* * * * *